US005170910A

United States Patent [19]

Hamm

[11] Patent Number: 5,170,910

[45] Date of Patent: Dec. 15, 1992

[54] CONTAINER WITH COLLAPSIBLE SPOUT

[75] Inventor: Peter A. Hamm, Winnipeg, Canada

[73] Assignee: Lawson Mardon Group Limited, Mississauga, Canada

[21] Appl. No.: 696,060

[22] Filed: May 6, 1991

[51] Int. Cl.[5] ..... B65D 37/00

[52] U.S. Cl. ..... 222/92; 222/527

[58] Field of Search ..... 222/526-528, 222/530, 92; 220/666, 905, 8; 215/1 C; 239/358

[56] References Cited

U.S. PATENT DOCUMENTS 2,950,029 8/1960 Winstead ..... 222/527
3,354,924 11/1967 Birrell et al. ..... 222/92
3,357,429 12/1967 Folkman et al. ..... 222/527
4,428,498 1/1984 Obey ..... 222/527
4,893,731 1/1990 Richter ..... 222/92

FOREIGN PATENT DOCUMENTS 2626551 8/1989 France ..... 222/527

*Primary Examiner*—Andres Kashnikow
*Assistant Examiner*—Lesley D. Morris
*Attorney, Agent, or Firm*—Baker & Daniels

[57] ABSTRACT

A blow-moulded container having a collapsible spout through which the parting line of the container passes. The spout has a neck and a shoulder with concentric ridges joined by thin webs to permit the shoulder to fold concertina style. The ridges do not cross the parting line.

4 Claims, 4 Drawing Sheets

CONTAINER WITH COLLAPSIBLE SPOUT

This invention relates to a blow moulded container having a collapsible pour spout. A typical container is the type used by campers to store water. Usually these are of relatively thin, low density polyethylene, and of box-like shape when filled and may be stored and transported in a folded, flat disposition. A collapsible pouring spout is formed on one wall of the container on the parting line i.e., on the line formed around the container at the separation plane of the mould within which the container is formed.

When erected, the pouring spout comprises a relatively thin walled frusto-conical shoulder portion made up of a plurality of continuous concentric annular ridges joined by relatively thin webs. The shoulder leads to an externally threaded, thicker walled, rigid neck for receiving a closure, a conduit or a spigot. To collapse the spout, the neck is pushed inwardly and the shoulder portion folds concertina-style, so that the shoulder is everted into the interior of the container and the upper edge of the neck is moved to be approximately flush with the wall of the container on which it is disposed. To move the spout to the erected position, the neck is grasped and pulled outwardly.

There is a problem with such containers in that necessarily the spout must be formed at the parting line. This means that the parting line runs through the thick and thin portions of the shoulder formed by the concentric ridges and the webs which connect them. This can cause the formation of pin holes in the webs and a very ragged parting line.

It is also to be noted that collapsing and erecting the spout requires significant effort often requiring the use of pliers or other tools and it is believed that this problem is exacerbated by the ragged junction on the shoulders.

While the background of the present invention has been exemplified by a camper's foldable water container, it will be appreciated that the invention will have application to any blow moulded container of the kind having a collapsible pouring spout of the kind described. In fact, containers of the general kind with which this invention is applicable are used in industry, in households and in the medical arts.

According to this invention, the ridges are discontinuous and do not pass through the parting line. In this way, a clean parting line is achieved.

Preferably, the ridges are each made up of two half ridges which terminate a short distance from the parting line.

From another aspect, there is provided a blow moulded thermoplastic container with a collapsible spout having an eversible shoulder made up of concentric ridges alternated with thin-walled webs, and a substantially rigid neck, said spout being disposed on a parting line of the container, the shoulder being of substantially uniform, thin cross-section in the region of the parting line.

An embodiment of the invention is illustrated in the accompanying drawings in which.

Figure 1:
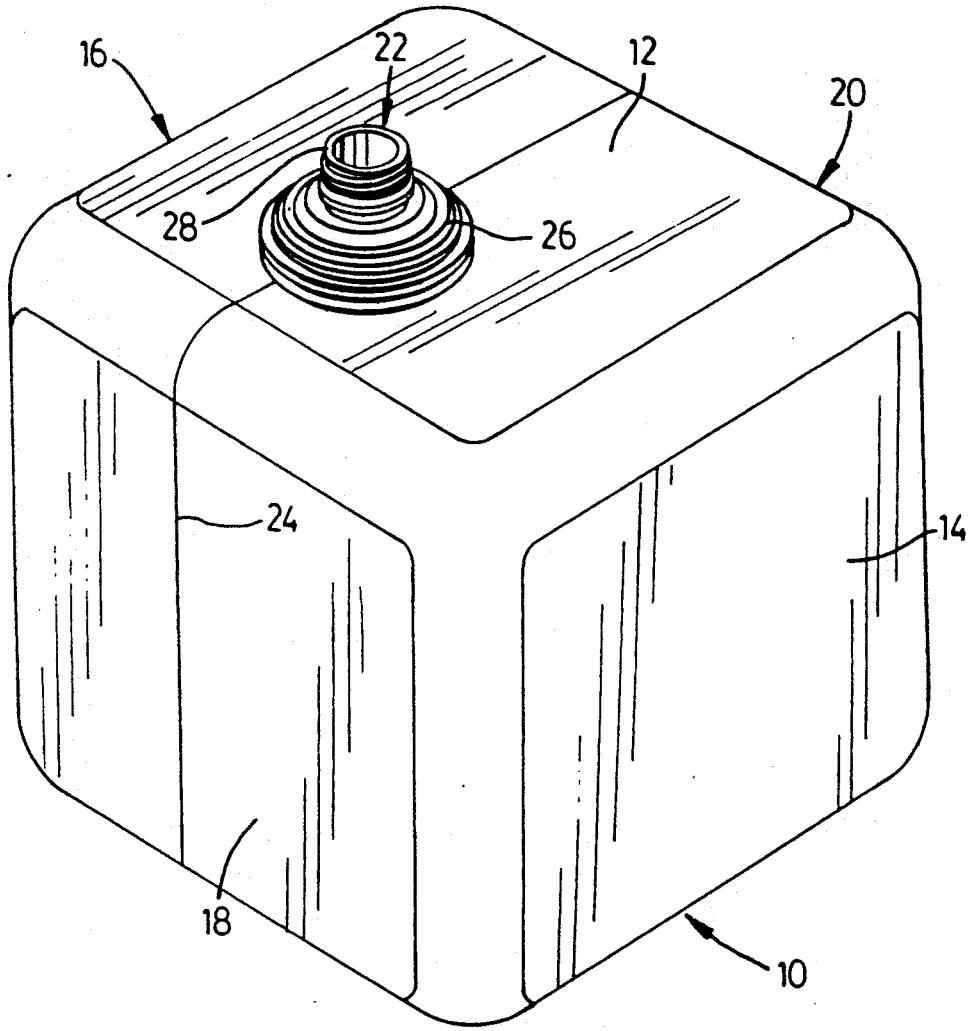
FIG. 1 (PRIOR ART)
FIG. 1 is a perspective view of a prior art container.

The container in FIG. 1 is blow moulded of low density polyethylene and comprises a bottom wall 10, top wall 12, side walls 14 and 16 and front and rear walls 18 and 20 respectively. A collapsible spout 22 is formed in the top wall close to the junction of that wall with the front wall 18. The parting line 24 extends centrally of the front, top rear and bottom walls and through the spout.

The container is collapsible by folding the front and bottom walls so that the junction line between those walls is moved to be parallel and adjacent to the junction between the top and rear walls. In this arrangement, each side wall is folded upon itself about lines extending from the front corners of the top wall to the lower corners of the rear wall i.e., the side walls each present double thickness triangular shapes.

From this position, the side walls are folded in the manner of a gusset to bring the front edge of the top wall adjacent and parallel to the rear edge of the bottom wall.

In this prior art arrangement, the pouring spout comprises a shoulder 26 of frusto-conical form being made up of a plurality of continuous, concentric thick ridges joined by thin webs. Atop the shoulders is a rigid neck 28 which is externally threaded to receive a closure or other fitting such as a spigot or conduit.

The spout is collapsible by applying downward (as viewed in FIG. 1) force to the neck which causes the shoulder to fold, concertina style, into the interior of the container. To erect the spout, the neck is grasped, if need be with a tool and pulled outwardly.

Figure 2:
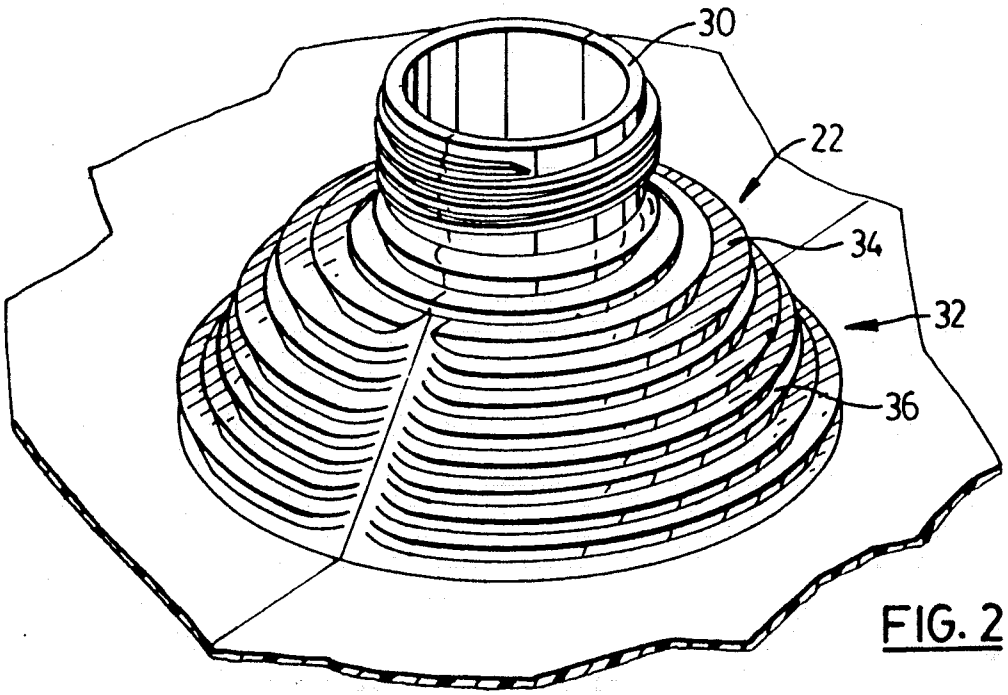
FIG. 2 is a perspective view of the pouring spout of a container.
Figure 3:
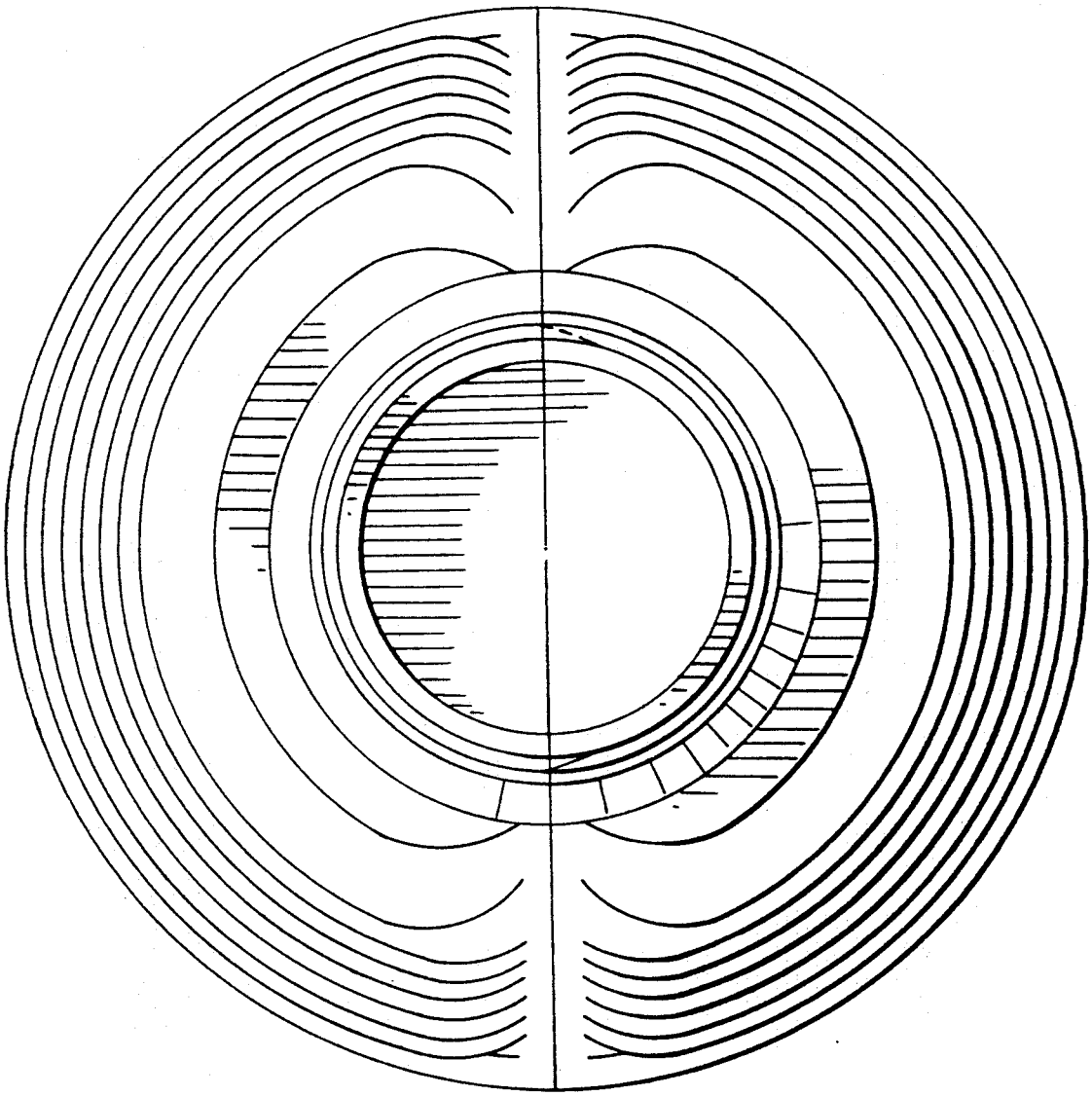
FIG. 3 is a plan view of the pour spout of FIG. 2.
Figure 4:
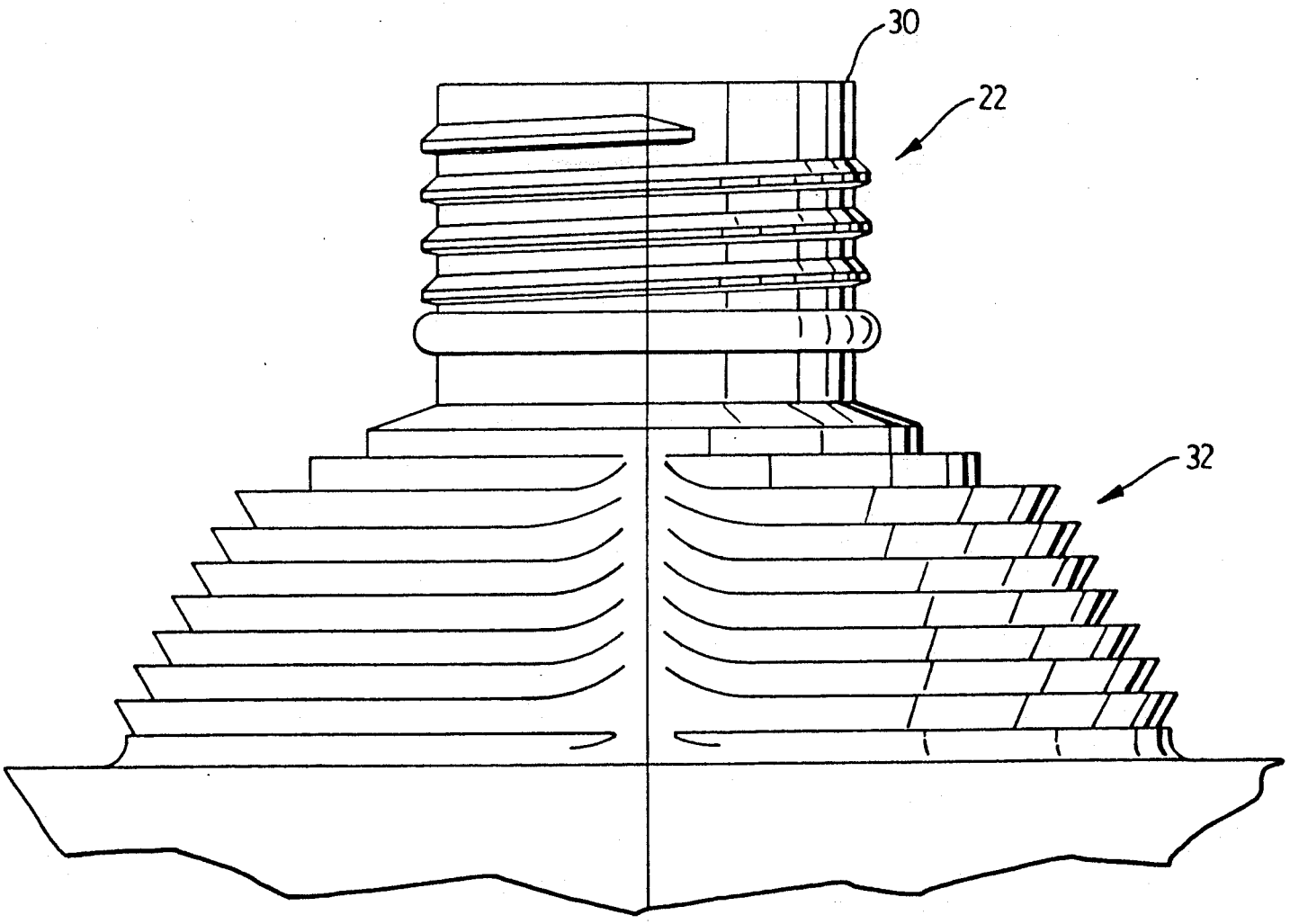
FIG. 4 is a side view of the spout of FIGS. 2 and 3.

It is in the formation of the spout that the embodiment of FIGS. 2 through 4 differs from the prior art structure. All other features are similar.

As can be seen, particularly in FIGS. 2 and 4, the spout 22 comprises an externally threaded, relatively thick-walled neck 30 which is substantially rigid. The external thread suits the spout to receive a closure or other fitting.

The shoulder 32 is of frusto-conical form and is made up of a plurality of relatively thick concentric ridges 34 joined to each other by continuous, concentric thin webs 36 which extend across the parting line.

It is to be noted that each ridge is in fact made up of two part-ridges, each part-ridge being somewhat less than one half the circumference of the ridge and terminating at each end short of the parting line. The parting line is thus of substantially constant thickness to all intents and purposes about equal to that of the webs 36. It will be appreciated that when one speaks of substantially constant thickness in this context, one is cognizant of the usual limitations of this type of blow moulding technique. There is almost always some flash at the parting line itself.

Essentially, the phrase means that the area is free of the major variations in thickness which occur in the prior art structure where the ridges extend across the parting line.

With this arrangement, it is found that the tendency for there to be pinhole flaws at the parting line in the region of the shoulder is substantially reduced. It is also noted that collapsing and erecting the spout is made easier.

I claim:

1. A blow-moulded container having a collapsible pour spout disposed on a parting line of the container, the pour spout comprising a generally frusto-conical shoulder having a plurality of concentric ridges joined by relatively thin webs, the ridges being discontinuous and not passing through the parting line and a neck projecting from the shoulder.

2. A container as claimed in claim 1 wherein a ridge is made up of two ridge sections, each section terminating short of the parting line.

3. A blow-moulded container having a collapsible pour spout disposed on a parting line of the container, the pour spout comprising a generally frusto-conical shoulder having a plurality of concentric ridges joined by relatively thin webs and a neck projecting from the shoulder wherein a region of the shoulder adjacent the parting line is of substantially constant thickness.

4. A blow-moulded container as claimed in claim 3 wherein said region is substantially thinner than the ridges.

* * * * *